US005115985A

United States Patent [19]

Satmer et al.

[11] Patent Number: 5,115,985

[45] Date of Patent: May 26, 1992

[54] METHOD FOR THE REGENERATIVE TREATMENT OF MAINLY CLAY-BOUND FOUNDRY OLD SAND

[75] Inventors: Franz Satmer, Schaffhausen, Switzerland; Ludwig Wilhelm, Engen, Fed. Rep. of Germany

[73] Assignee: Georg Fischer AG, Schaffhausen, Switzerland

[21] Appl. No.: 619,044

[22] Filed: Nov. 28, 1990

[30] Foreign Application Priority Data

Nov. 28, 1989 [CH] Switzerland ..... 04259/89

[51] Int. Cl.[5] ..... B02C 23/00

[52] U.S. Cl. ..... 241/14; 241/24; 241/DIG. 10; 55/459.1

[58] Field of Search ..... 241/14, 24, DIG. 10; 164/5; 55/459.1

[56] References Cited

U.S. PATENT DOCUMENTS

| | | | |
|---|---|---|---|
| 3,312,403 | 4/1967 | Zifferer | 241/24 |
| 3,863,847 | 2/1975 | Day et al. | 241/24 X |
| 4,137,675 | 2/1979 | Cina et al. | 241/DIG. 10 X |
| 4,354,641 | 10/1982 | Smith | 241/DIG. 10 X |
| 4,436,138 | 3/1984 | Kondo | 241/275 X |
| 4,566,637 | 1/1986 | Deve | 241/23 |
| 4,978,076 | 12/1990 | Andrews et al. | 241/DIG. 10 X |
| 5,034,035 | 7/1991 | Satmer et al. | 241/DIG. 10 X |

*Primary Examiner*—Mark Rosenbaum
*Assistant Examiner*—Frances Chin
*Attorney, Agent, or Firm*—Bachman & LaPointe

[57] ABSTRACT

A method for regenerating foundry old sand which method combines impact and shearing stress of the sand grains which occurs with simultaneous dust removal. The dust removed by suction contains non-burned bentonite and carbon parts which can be re-used in the same way as the regenerated material of core sand. Environmental pollution and quantities for dumping are drastically reduced.

5 Claims, 2 Drawing Sheets

METHOD FOR THE REGENERATIVE TREATMENT OF MAINLY CLAY-BOUND FOUNDRY OLD SAND

BACKGROUND OF THE INVENTION

The present invention relates to method for the regenerative treatment of mainly clay-bound foundry old sand for the re-use of the latter.

In the case of molding material circulation in a foundry, in which clay-bound greensand is used for the production of molds, old sand which occurs at the point of shaking-out is fed to a processing plant. This old sand is a mixture of mainly clay-bound molding sand and smaller parts of chemically bound core sand. Active bentonite and coked, porous, unused black substances (coal dust) are contained in the old sand. As a result of the action of heat of the casting metal, a portion of the bonding clay or bentonite is dead-burned, whereby a ceramic, adherent, porous surface layer or shell (burned fireclay) is formed on the quartz grains. This old sand can regain binding strength with addition of new bonding clay and water.

The molding material reprocessing systems operate with a high degree of efficiency. The result of this is that the quartz sand part, supplied by means of core sands, generates a surplus in the way of molding material which must be removed from the system. The transportation away and the dumping of this quantity of old sand entail costs and burden the environment.

The object of the present invention is to propose a method with the aid of which both economical regenerative treatment of foundry old sand, which treatment is easy to operate, and the recovery of usable dust become possible.

SUMMARY OF THE INVENTION

The foregoing object is achieved by way of the present invention wherein the sand grains are repeatedly accelerated and decelerated and scoured by means of combined impact and shearing stress and thereby freed of the usable and dead-burned binder shells or surface layers which are fixed on the grains, with the dust, thereby scoured off from the sand grains during the treatment, being removed by suction in a controlled manner.

BRIEF DESCRIPTION OF THE DRAWINGS

A preferred exemplary embodiment is explained in greater detail with the aid of the enclosed figures wherein.

DETAILED DESCRIPTION

In accordance with the process of the present invention, the brittle clay shells or surface layer of binder material which are fixedly burned on the quartz grains are blasted or ground off in a drum 10 by means of impact and shearing stress, that is, by repeated intensive acceleration and deceleration.

By means of this dry scouring in the drum 10, the comparatively soft and loosely bound prepared substances as well as the coal-bearing constituents are ground to powder. These powdery fractions are separated by means of air separation by suction and are removed by suction as dust via line 12 in a fractionated manner. It is important in this connection that the dust is removed continuously from the scouring vessel 10. The fractionated removal by suction is controlled on the basis of size differences of the dust by controlling the suction capacity and time of operation. The scouring effect is not attenuated and the process abrades the burned fireclay almost completely from the sand grain.

Figure 1:
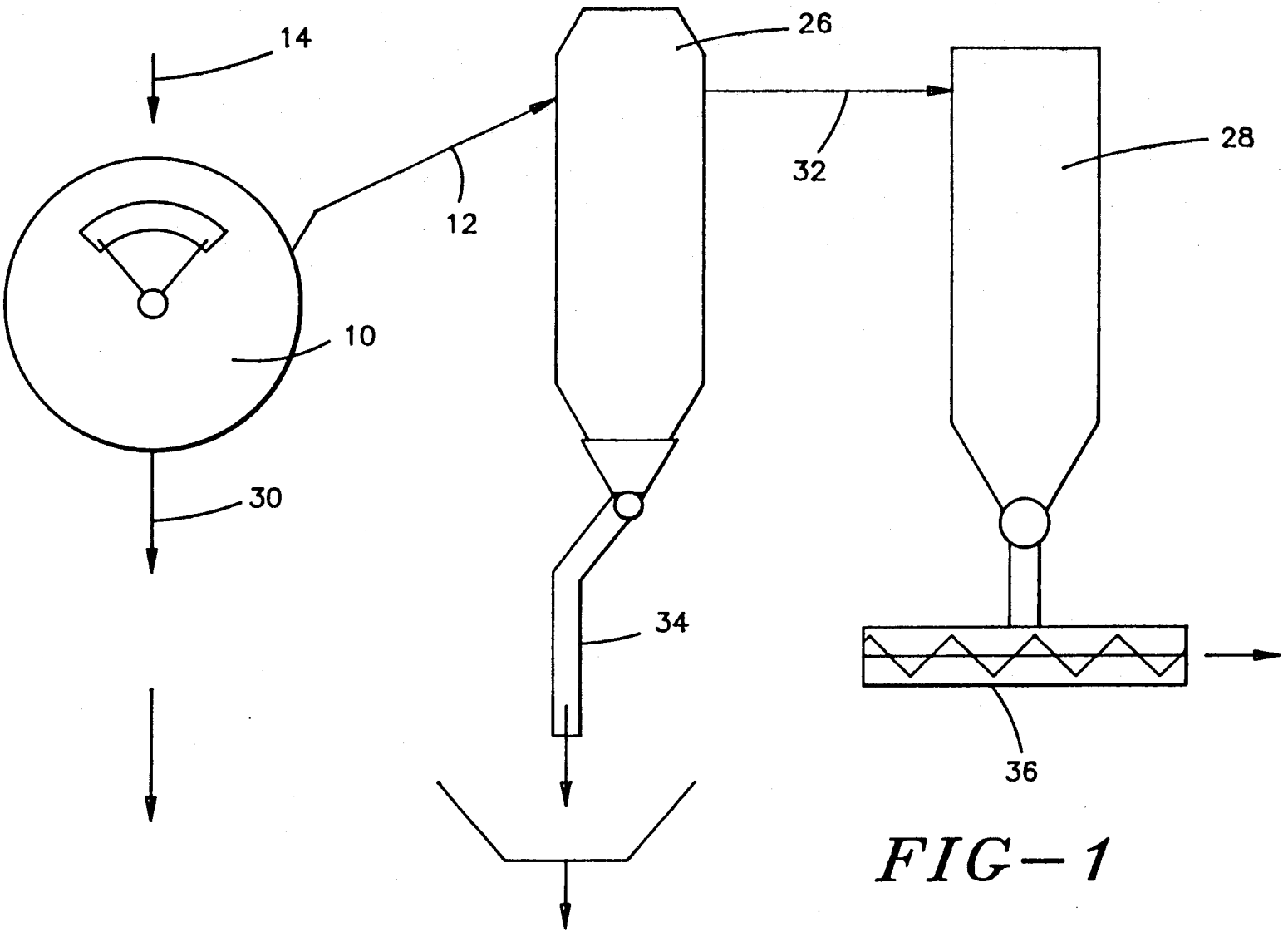
FIG. 1 is a schematic illustration of the process of the present invention.
Figure 2:
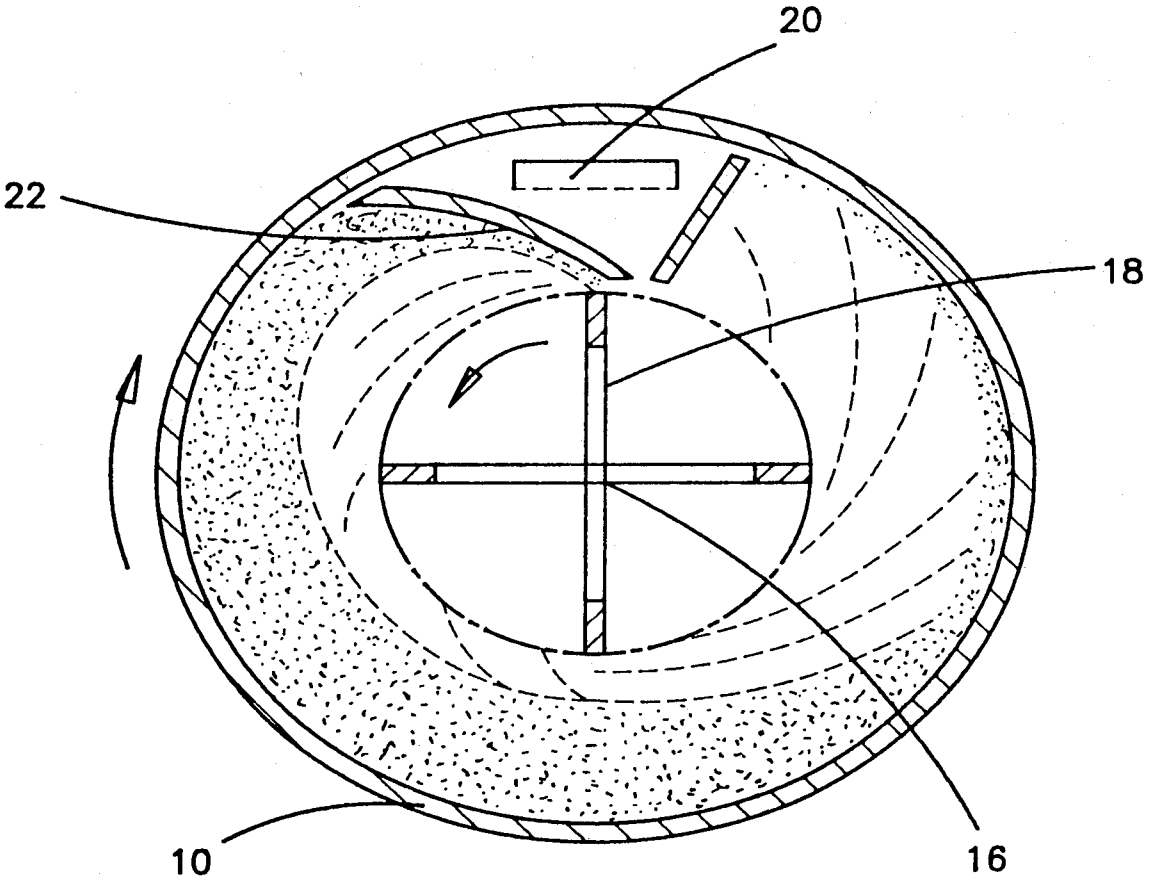
FIG. 2 is a partial sectional view of a drum usable in the process of the present invention.

For the purposes of treatment, the drum 10, which is arranged with a preferably horizontal axis, is filled with a given quantity of old sand via line 14. The drum 10 is driven in a first direction by suitable motor means. A stirrer shaft 16 with four arm stirrers 18 runs in the opposite direction as drum 10, see FIG. 2. A dust removal hood 20 is secured in a portion of the drum interior space. A stripper 22, which is secured in the region of the suction hood 20, conducts the rotating sand to the stirrer blades 18. Air ducts, not shown, which are arranged in a labyrinth-like manner, prevent uncontrolled emergence of the sand by way of the suction hood.

Loading of the drum takes place by way of a channel central piece. The old sand runs into the drum through the channel 14, followed by fresh air. The dust is removed by suction in a fractionated manner through the second channel 12. Air containing dust is purified by means of a cyclone separator 26 and a subsequently connected filter 28. The drum 10 is emptied of regenerated sand by way of a pneumatically operated flap door, not shown, to channel 30. Loading and emptying take place with the drum running.

The regenerated sand is conducted to the core-making section after the drum 10 has been emptied. The dust, removed by suction from the drum 10, in the cyclone separator 26 is separated into usable dust (non-burned bentonite and carbon parts) and waste dust. In this connection, the usable dust is continuously removed from the cyclone separator 26 via line 32 to filter 28. Waste dust is removed via line 34. The usable dust is conducted back to the foundry via conveyor 36 as additive for the molding sand.

In order to bring the old sand back to core sand quality, dust is continuously removed by suction in one working operation at room temperature and the oolith shell (burned fireclay) is separated from the quartz grain.

By means of this controlled removal by suction in a fractionated manner, valuable and unused molding material components such as coal dust and bentonite can be separated from the oolith (burned fireclay.) As a result, the quantity of old material to be dumped is reduced to less than 15%.

The advantage of this proposed method does not only lie in the regeneration of the old sand alone, but rather also in the fact that unused molding material components such as bentonite and carbon are recovered and in the case of sand-processing no longer need to be introduced anew in the system.

Substantial, economical significance of this method lies therein. As a result of the reduction of the quantity of old sand to be dumped, a substantial contribution is made to environmental protection.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for regenerating old clay-bound foundry sand characterized by sand grains having a surface layer of dead burned binder bonded thereon comprising scouring said old clay-bound sand by combined impact and shearing stress so as to separate said surface layer from said sand grain, grinding said separated surface layer to powdery fractions, separating said powdery fractions from said sand grains by suctioning off said powdery fractions in a fractionated manner from said sand grains, feeding said suctioned off powdery fractions to a separator, separating said powdery fractions into (1) usable dust comprising non-burned bentonite and carbon parts and (2) unusable dust and recirculating said usable dust and said sand grains for further foundry use.

2. A process according to claim 1 wherein the dust is continuously removed by suction.

3. A process according to claim 1 wherein the dust is separated from the sand grains by means of air separation.

4. A process according to claim 1 wherein the fractionated removal by suction is controlled on the basis of size differences of the dust by controlling the suction capacity and time of operation.

5. A process according to claim 1 wherein usable dust is separated from the powdery fractions and introduced back into the molding material circulation.

* * * * *